United States Patent [19]

Center

[11] 4,008,538

[45] Feb. 22, 1977

[54] GUN

[76] Inventor: Warren A. Center, Laurel Road, Westminster, Mass. 01473

[22] Filed: Mar. 14, 1975

[21] Appl. No.: 558,467

Related U.S. Application Data

[63] Continuation of Ser. No. 405,021, Oct. 10, 1973, abandoned, which is a continuation of Ser. No. 235,617, March 17, 1972, abandoned, which is a continuation of Ser. No. 869,135, Oct. 24, 1969, abandoned.

[52] U.S. Cl. ..... 42/78; 42/79

[51] Int. Cl.[2] ..... F41C 21/00

[58] Field of Search ..... 42/78, 79; 89/14 C

[56] References Cited

UNITED STATES PATENTS

| | | | |
|---|---|---|---|
| 476,246 | 6/1892 | Burgess | 42/79 |
| 587,801 | 8/1897 | Durnford | 42/78 |
| 1,605,393 | 11/1926 | Cutts, Jr. | 89/14 C |
| 2,322,370 | 6/1943 | Lance | 89/14 C |
| 2,490,829 | 12/1949 | Noll | 42/79 |
| 3,163,953 | 1/1965 | Bridge, Sr. | 42/79 |
| 3,492,750 | 2/1970 | Ashbrook et al. | 42/79 |

*Primary Examiner*—Charles T. Jordan

*Attorney, Agent, or Firm*—Norman S. Blodgett; Gerry A. Blodgett

[57] ABSTRACT

This invention has to do with a gun and, more particularly, to a firearm having a rifled barrel which can be used effectively with shotgun shells.

3 Claims, 6 Drawing Figures

GUN

This is a continuation of application Ser. No. 405,021 filed Oct. 10, 1973, now abandoned, which in turn is a continuation of application Ser. No. 235,617 filed Mar. 17, 1972, now abandoned, which in turn is a continuation of application Ser. No. 869,135 filed Oct. 24, 1969, now abandoned.

BACKGROUND OF THE INVENTION

For many years attempts have been made to use shotgun shells in guns designed for shooting bullets. Unfortunately, the barrels of such firearms are rifled and, as the shell passes down the barrel, the rifling causes the individual pellets to move in a helical path. When the pellets leave the muzzle of the gun, centrifugal action causes the pellets to move outwardly from the barrel axis. At any appreciable distance from the gun, the pellets have moved outwardly so far from the axis that the group is useless either for target shooting or for shooting small game. These and other difficulties experienced with the prior art devices have been obviated in a novel manner by the present invention.

It is, therefore, an outstanding object of the invention to provide a gun that may be used effectively with both bullets and shotgun shells.

Another object of this invention is the provision of a firearm having a rifled barrel that may be used for shooting shotgun shells without the pellets moving laterally of the barrel axis as they leave the gun.

A further object of the present invention is the provision of a rifled gun that gives a close pellet pattern when used with shotgun shells.

It is another object of the instant invention to provide a rifled handgun which can be used with birdshot and give a pattern small enough to knock down small game despite the small weight of pellet necessitated by even the largest caliber of bullet.

A still further object of the invention is the provision of a handgun which makes an excellent survival gun because of its ability to shoot both bullets and shotgun shells with accuracy.

With these and other objects in view, as will be apparent to those skilled in the art, the invention resides in the combination of parts set forth in the specification and covered by the claims appended hereto.

SUMMARY OF THE INVENTION

In general, the invention has to do with a gun for use alternately with a shotgun shell and a bullet. It has a barrel with spiraled rifling and a tubular element attachable to the muzzle of the barrel. The inner surface of the element is formed with longitudinally-extending vanes to remove spiral motion from the shot to prevent it from spreading as it leaves the gun.

More specifically, a second tubular element provided with gas vents is interposed between the muzzle of the barrel and the first tubular element. The second tubular element is provided with internal threads, and the first tubular element is provided at one end with cooperating external threads, the first tubular element being provided with flat wrench-engaging surfaces. The vanes are located away from the threaded end and are tapered from that end to their portions of greatest radially inwardly-extending position at the other end.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
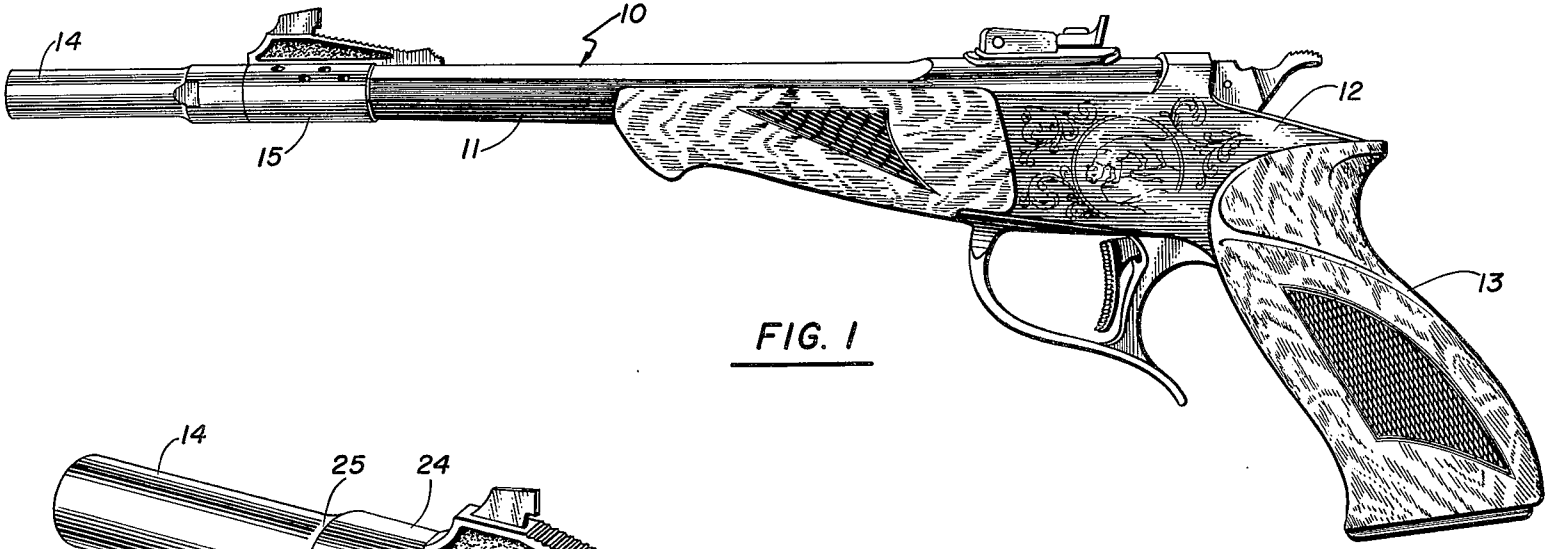
FIG. 1 is a perspective view of a gun embodying the principles of the present invention.

Referring first to FIG. 1, wherein are first shown the general features of the invention, the gun, indicated generally by the reference numeral 10, is shown as having a rifled barrel 11 associated with a frame 12, a grip 13. The gun is of the type shown and described in U.S. Pat. No. 3,561,149. To the muzzle are fastened a first tubular element 14 and a second tubular element 15. The first tubular element 14 is provided with axially-extending vanes 16 (see FIGS. 5 and 6).

Figure 2:
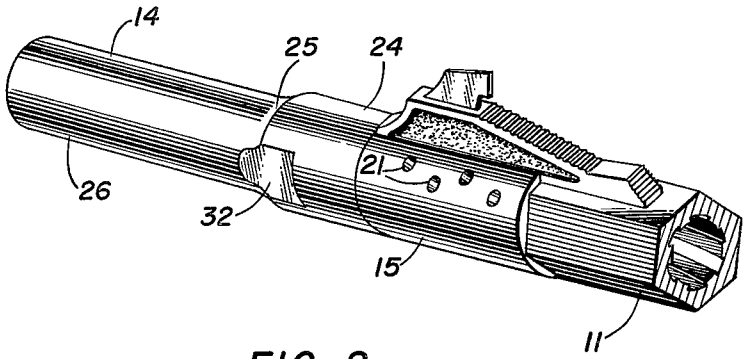
FIG. 2 is a perspective view of a portion of the gun.

In FIG. 2 it can be seen that the first tubular element 14 is attached to one end of the second tubular element 15, the other end of which is connected to the muzzle of the barrel 11. Extending over the barrel and the second tubular element is a front sight.

Figure 3:
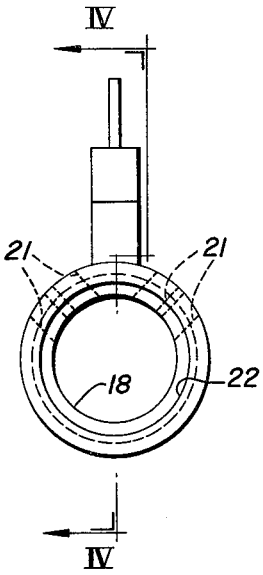
FIG. 3 is an end elevational view of a portion of the gun.
Figure 4:
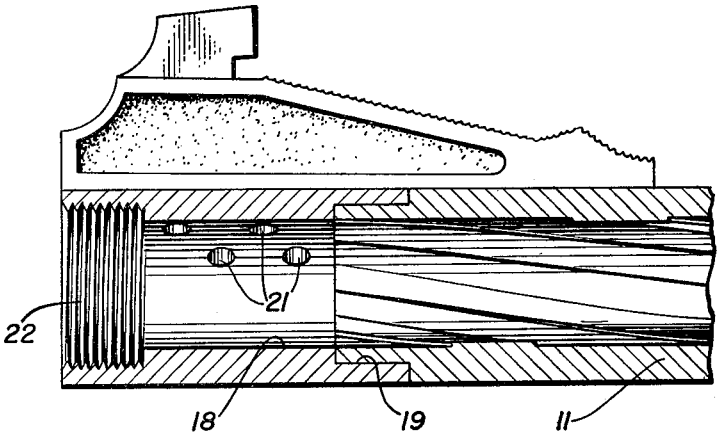
FIG. 4 is a sectional view taken on the line IV—IV of FIG. 3.

FIGS. 3 and 4 show the manner in which the second tubular element 15 is constructed. Through the element extends a bore 18 which is provided with a cylindrical counterbore 19 which fits tightly over the end of the barrel 11. From the main bore extend gas vents 21 located in the upper quadrants only. At the end opposite the counterbore the bore 18 is provided with internal threads 22.

Figure 5:
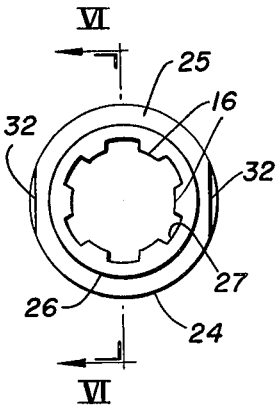
FIG. 5 is an end elevational view of another portion of the gun.
Figure 6:
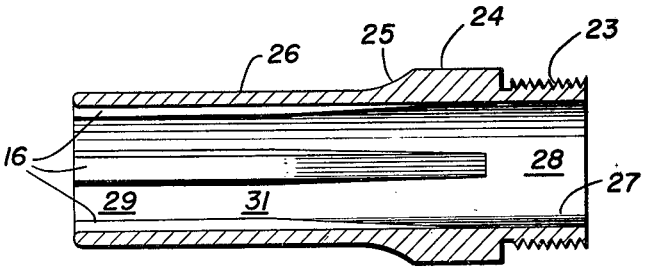
FIG. 6 is a sectional view taken on the line VI—VI of FIG. 5.

The details of the first tubular element 14 are shown in FIGS. 5 and 6. At one end it is provided with external threads 23 which engage cooperatively with the internal threads 22 of the second tubular element. At that end of the element, it is provided with a cylindrical portion 24 which is the same size as the corresponding outer surface of the other element. The portion 24 merges through a transition portion 25 to a smaller cylindrical portion 26.

Through the element runs a bore 27 which is exactly the same diameter as the bore 18. At the threaded end of the bore is a portion 28 which is free of the vanes 16. At the other end of the bore is a portion 29 throughout which the vanes 16 have their greatest radial inward extent. Between the two portions lies a portion 31 in which the vanes are tapered. The surface 24 is provided with flat wrench-engaging surfaces 32.

The operation of the apparatus will now be readily understood in view of the above description. In a practical embodiment of the invention, the barrel is designed for use with 45 caliber bullets. When used with such bullets, the first tubular element 14 is removed. When fired, the bullet passes down the barrel and is caused to spin by the rifling. The bullet is maintained on the axis of the barrel as it leaves the gun because of this spin by gyroscopic principle.

When the gun is used with a shotgun shell, the 0.45 chamber is capable of receiving a 0.410 shell. The first tubular element is fastened in place by the interengagement of the external threads 23 with the internal threads 22. The firing of the gun projects the pellets down the barrel and the rifling causes the body of pellets to rotate about the axis of the barrel. As the pellets pass through the bore 27 of the tubular element 14 the straight vanes 16 remove their helical motion, so that they leave the gun moving in straight lines parallel to the barrel axis. There is, therefore, no action of centrifugal force and no tendency of the pellets to spread.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A gun for use alternately with a shotgun shell and a bullet, comprising:

a. a barrel having spiraled rifling, an axial bore, and a muzzle at an end of the barrel, b. a first tubular integral element attachable to the muzzle of the barrel and having a first end and a second end, the inner surface of the element being formed with longitudinally-extending vanes to remove spiral motion from shot to prevent it from spreading as it leaves the gun, the inner surface of the tubular element consisting of a cylindrical bore extending entirely therethrough and coaxial with the bore of the barrel, the tubular element consisting of a first portion located adjacent the first end of the element adjacent the muzzle and having no vanes, and a second portion located adjacent the second end of the element having vanes which extend inwardly a substantial distance, thereby defining a cylinder coaxial with and having a smaller diameter than the bore of the barrel, and a third portion between the other two portions having parts of the vanes which increase smoothly in a radial extent from a zero radial extent at the first portion to the full radial extent at the second portion while the bore remains the same size, the second and third portions extending substantially the same substantial axial distance, and c. a second tubular element provided with gas vents interposed between the muzzle of the barrel and the first-mentioned first tubular element, the outer end of the second tubular element being provided with internal threads and the first tubular element being provided at the said first end with cooperating external threads, the first tubular element being provided with flat wrench-engaging surfaces.

2. A gun as recited in claim 1, wherein a front sight is mounted on the barrel and the second tubular element, the sight being axially co-extensive with substantial portions of both the barrel and the second tubular element.

3. A gun as recited in claim 1, wherein the gun includes a handle extending downwardly from the barrel and wherein the gas vents all exit upwardly of the barrel.

* * * * *